United States Patent [19]

Chochev et al.

[11] Patent Number: 4,787,231

[45] Date of Patent: Nov. 29, 1988

[54] ROLLER MACHINE FOR PROFILE COLD BENDING

[75] Inventors: Tancho P. Chochev, Stroevo; Todor D. Andonov, Plovdiv, both of Bulgaria

[73] Assignee: Znorc "Metalni Konstruckcit", Trud, Bulgaria

[21] Appl. No.: 12,104

[22] Filed: Feb. 6, 1987

[51] Int. Cl.[4] ..... B21D 5/14

[52] U.S. Cl. ..... 72/176; 72/178; 72/179; 72/181

[58] Field of Search ..... 72/176, 178, 179, 181, 72/234, 250, 251

[56] References Cited

U.S. PATENT DOCUMENTS

| | | | |
|---|---|---|---|
| 2,481,138 | 9/1949 | Mercer | 72/179 |
| 3,748,884 | 7/1973 | Colbath | 72/181 |
| 3,914,971 | 10/1975 | Colbath | 72/178 |
| 4,558,577 | 12/1985 | Trishevsky et al. | 72/181 |

FOREIGN PATENT DOCUMENTS

| | | | |
|---|---|---|---|
| 1777039 | 10/1971 | Fed. Rep. of Germany | 72/181 |

*Primary Examiner*—David Jones

*Attorney, Agent, or Firm*—Klein & Vibber

[57] ABSTRACT

A roller machine for profile cold bending includes a bearing framework with mounted supports, carrying power driven shape forming calibers. The bearing framework is composed of at least two module components at the adjacent ends of which are mounted supports, connected between them with crosswise to the machine's axis horizontal bars with which, by means of end carriers, are joined two interparallel blocks of bars, each of which comprises lengthwise bars, connected through vertical bearers, at one side of which, pertaining to each one of the bar blocks, are mounted freely rotating horizontal, cylindrical and shape forming rollers, secured at a fixed angle per each transition, while at the other side of the vertical bearers are mounted on guides axially movable free rotating cylindrical rollers, but over at least one of the module components, in crosswise position to the machine's axis, are mounted a top and a bottom axially movable shape forming blocks, fastened by a clamping device to a top and a bottom horizontal rollers respectively, while the top and bottom shape forming blocks are fixed in operating position by way of fixing couplings.

4 Claims, 5 Drawing Sheets

ROLLER MACHINE FOR PROFILE COLD BENDING

BACKGROUND OF THE INVENTION

The invention refers to a roller machine for profile cold bending, which may find its application in metal processing and in the production of beams from single strip pieces.

Known roller machines for profile cold bending consist of a load bearing roller with mounted supports carrying power driven form shaping calibers. The form shaping calibers are connected unilaterally through pivot mounted rollers with reducers, which are interconnected in one common power driven unit.

The disadvantages of the known roller machines are realized in the fact that for the production of each separate profile item it is necessary to have a separate set of form shaping calibers, which posses comparatively large overall dimensions due to considerations of strength brought about by the machine's construction. Besides this, as a result of the differences in the peripheral velocities of the calibers' cross-section and of the advancing velocity of the work piece, there results friction losses in the sliding movement, which mandates operation of the machine with increased energy consumption.

An object of the present invention is to create a roller machine for profile cold bending, which may produce different types of profiles with one and the same form shaping caliber by stepless changes in their cross-section and by diminishing the energy consumption and improving thereby the Utilization Factor.

SUMMARY OF THE INVENTION

This object is achieved by a roller machine for profile cold bending, which includes a load bearing framework with mounted supports bearing power driven form shaping calibers.

In accordance with the invention the load bearing framework consists of at least two module components at whose adjacent ends the supports are mounted. The latter are interconnected by horizontal bars lying in transverse position to the machine's axis, to which by means of carries two parallel to each other blocks of bars are connected. Each one of these bar blocks consists of lengthwise positioned bars, connected by vertical carriers at one end of which of each separate bar block are mounted in free rotation a horizontal, a cylindrical and a form shaping roller, secured at a fixed angle to each transition operating stage.

On the other side of the vertical supports, on guides along the axis, free rotating movable cylindrical rollers are mounted. On at least one of the module components, in crosswise position to the axis, are mounted a top and a bottom axially moving blocks, which are secured by clamping devices to a top and a bottom horizontal rollers. The top and bottom blocks are fixed in operating position by means of fixing couples.

The advantages of the rollers machine, according to the invention, are expressed in the fact that by employed one set of small-dimension shape forming calibers, and with a considerably lighter weight of the machine's construction, it is possible to produce different kinds of profiles with steplessly changing cross-section dimensions, which leads to realizing economy in materials. Due to the considerably lighter machine construction and by exchanging the friction in sliding with friction in rolling, it is possible to achieve a several times smaller energy consumption with a considerable increase of the Utilization Factor.

BRIEF DESCRIPTION OF THE DRAWINGS

With these and other objects in view, which will become apparent in the following detailed description, the present invention, which is shown by example only, will be clearly understood in connection with the accompanying drawing, in which.

DESCRIPTION OF THE PREFERRED EMBODIMENT

Figure 1:
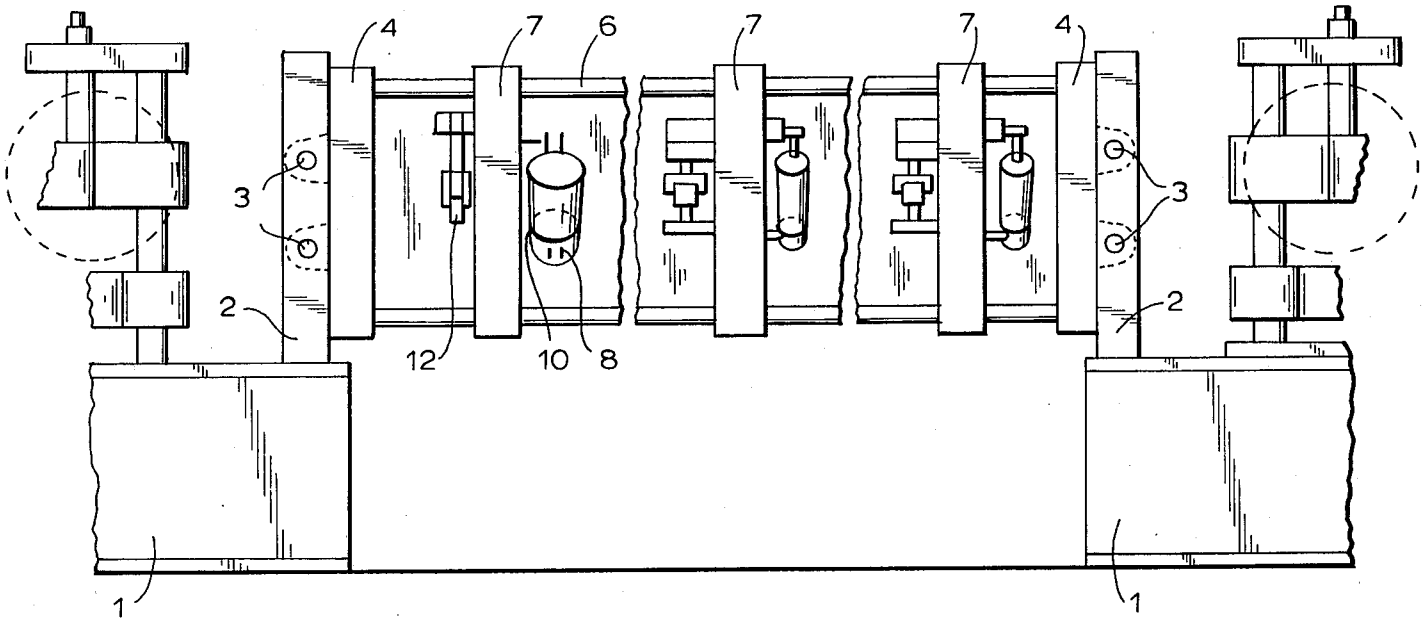
FIG. 1 represents a side view of the machine with two module components.
Figure 3:
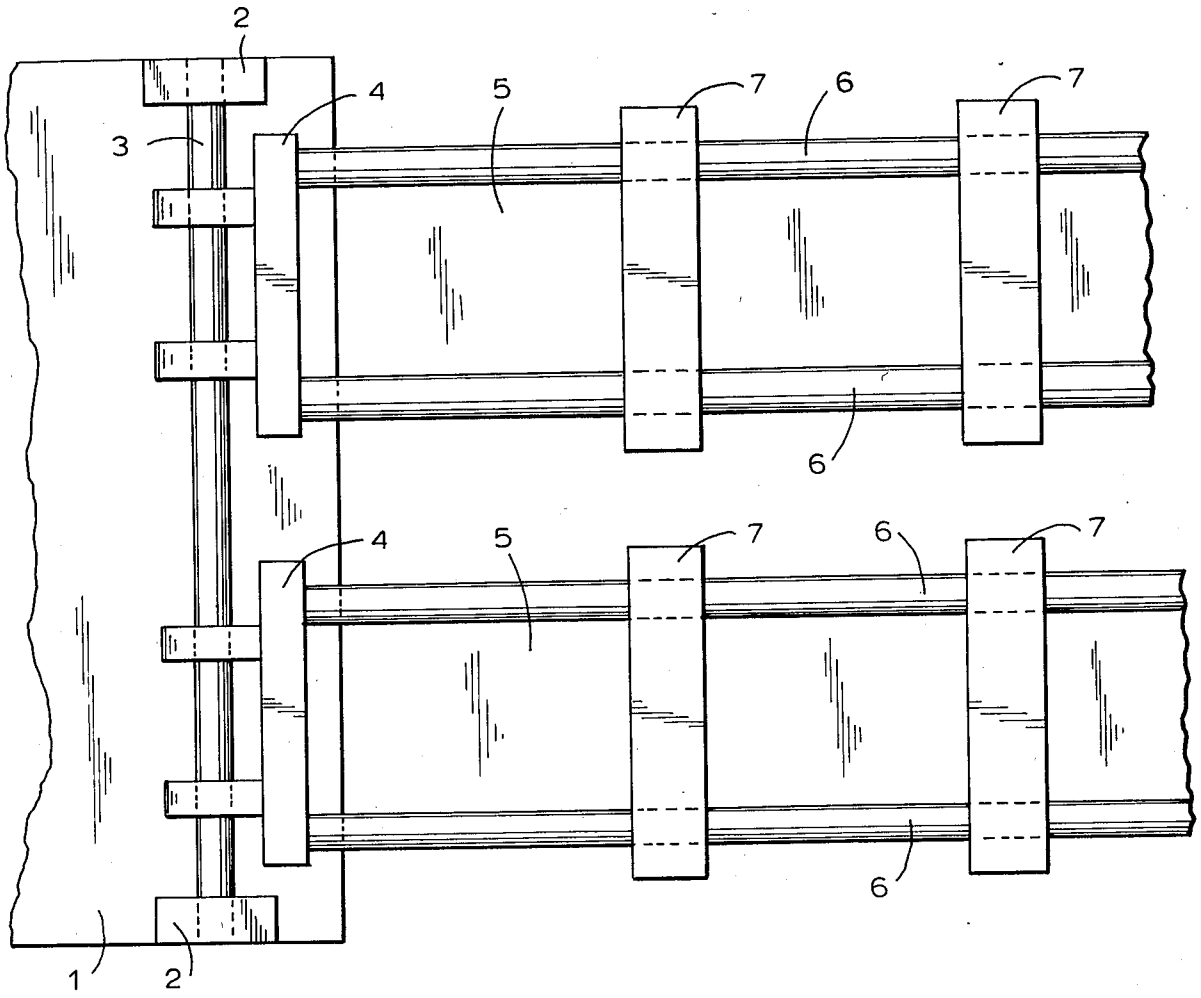
FIG. 3 shows a plan view of the bar blocks.

Referring to FIGS. 1 and 3, the roller machine for profile cold bending comprises a bearing framework with at least two module components 1. In the module components 1 adjacent ends are mounted two supports 2, interconnected by two crosswise positioned horizontal bars 3 to the machine's axis. To the horizontal bars 3, by means of end carriers 4, are attached two bar blocks 5, parallel to each other and to the machine's axis, which give the possiblity for crosswise shifting one against the other and for fixing them in a given operating position.

Each one of the bar blocks 5 comprises horizontal lengthwise bars 6, parallel to the machine's axis, which are interconnected by vertical bearers 7 at the places for the separate processing stages with a view of achieving a gradual change of the profile by the bending process.

Figure 4:
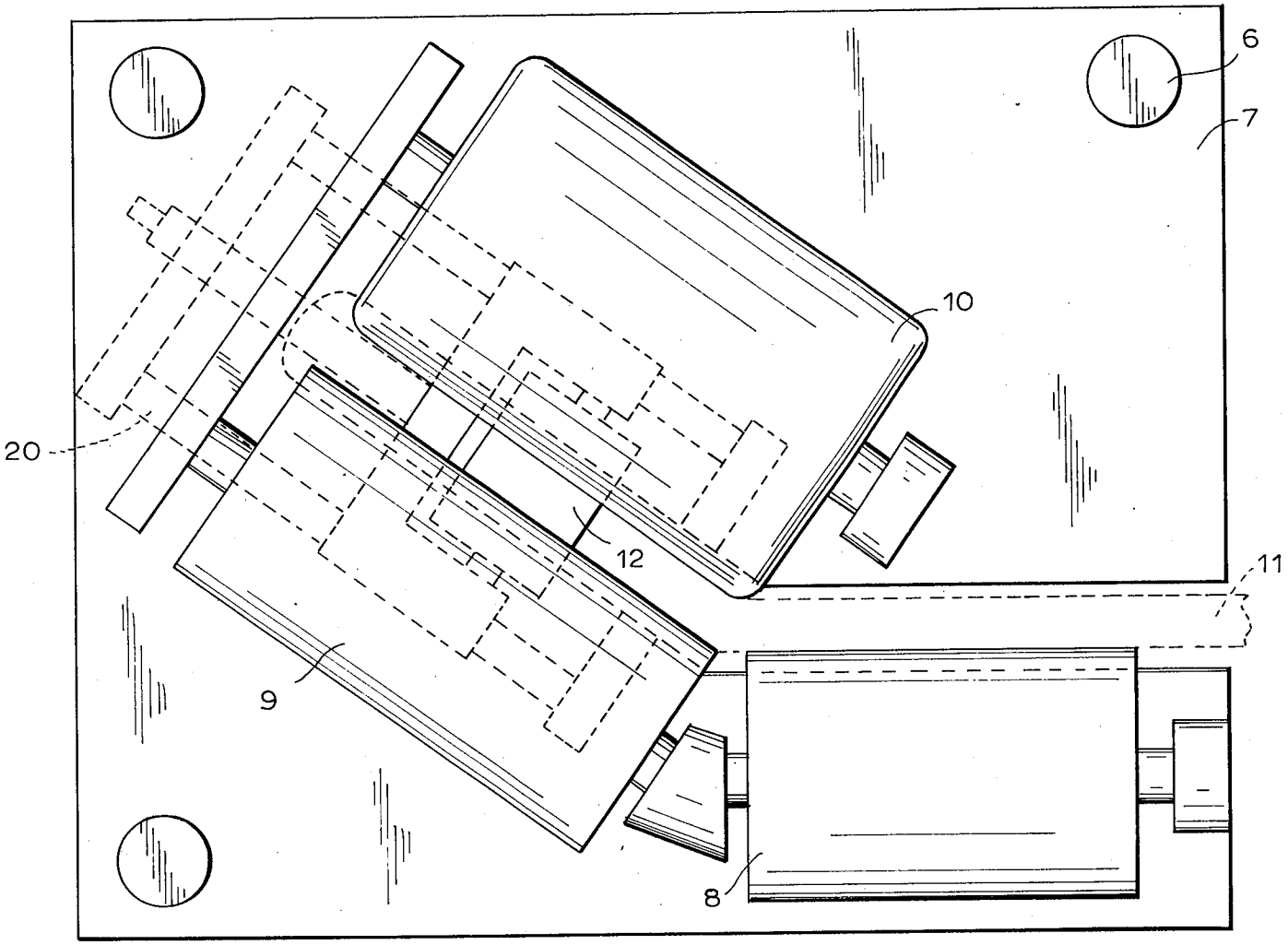
FIG. 4 shows a front view of the vertical carriers in one of the bar blocks.
Figure 5:
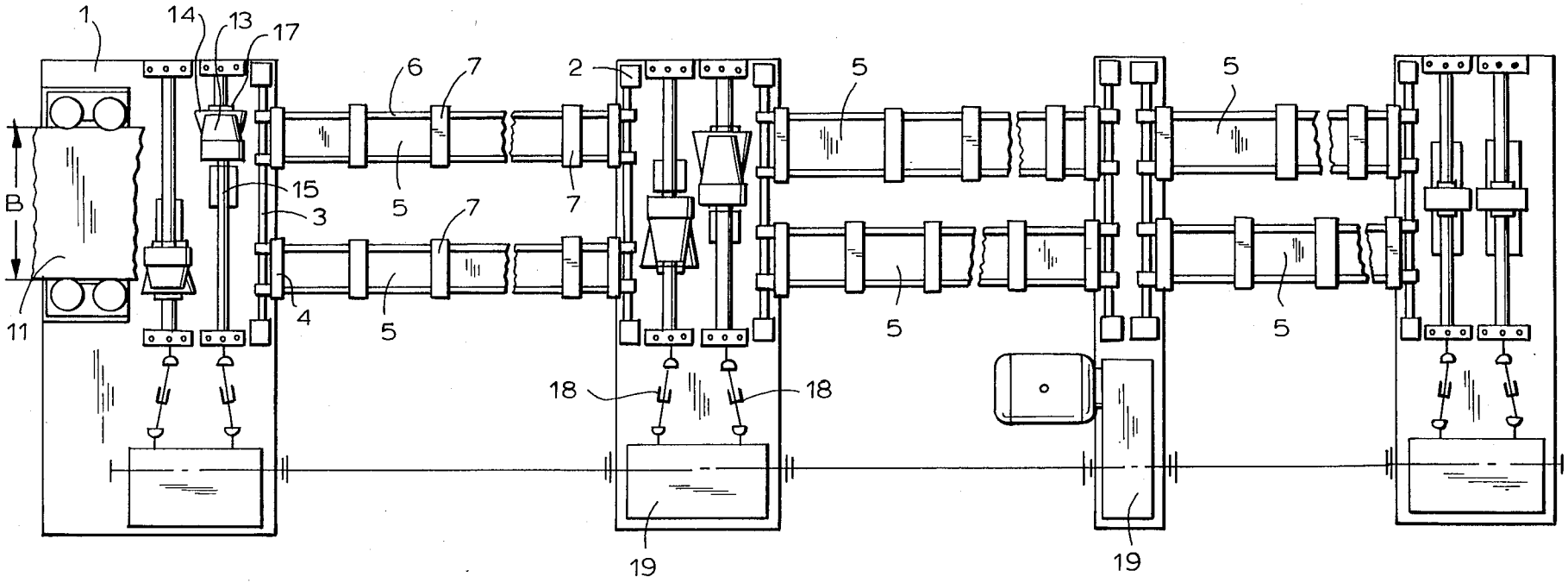
FIG. 5 shows a general view of the machine.

Referring to FIGS. 1 and 4, on one of the sides of the vertical bearers 7, for each one of the bar blocks 5 are mounted, at a fixed angle for each separate processing stage, in free rotation, a horizontal 8, cylindrical 9 and shape forming 18 rollers, which are oriented in accordance with the shape imparting cross-section halves of the profile formed work piece 11 at each processing stage.

Figure 2:
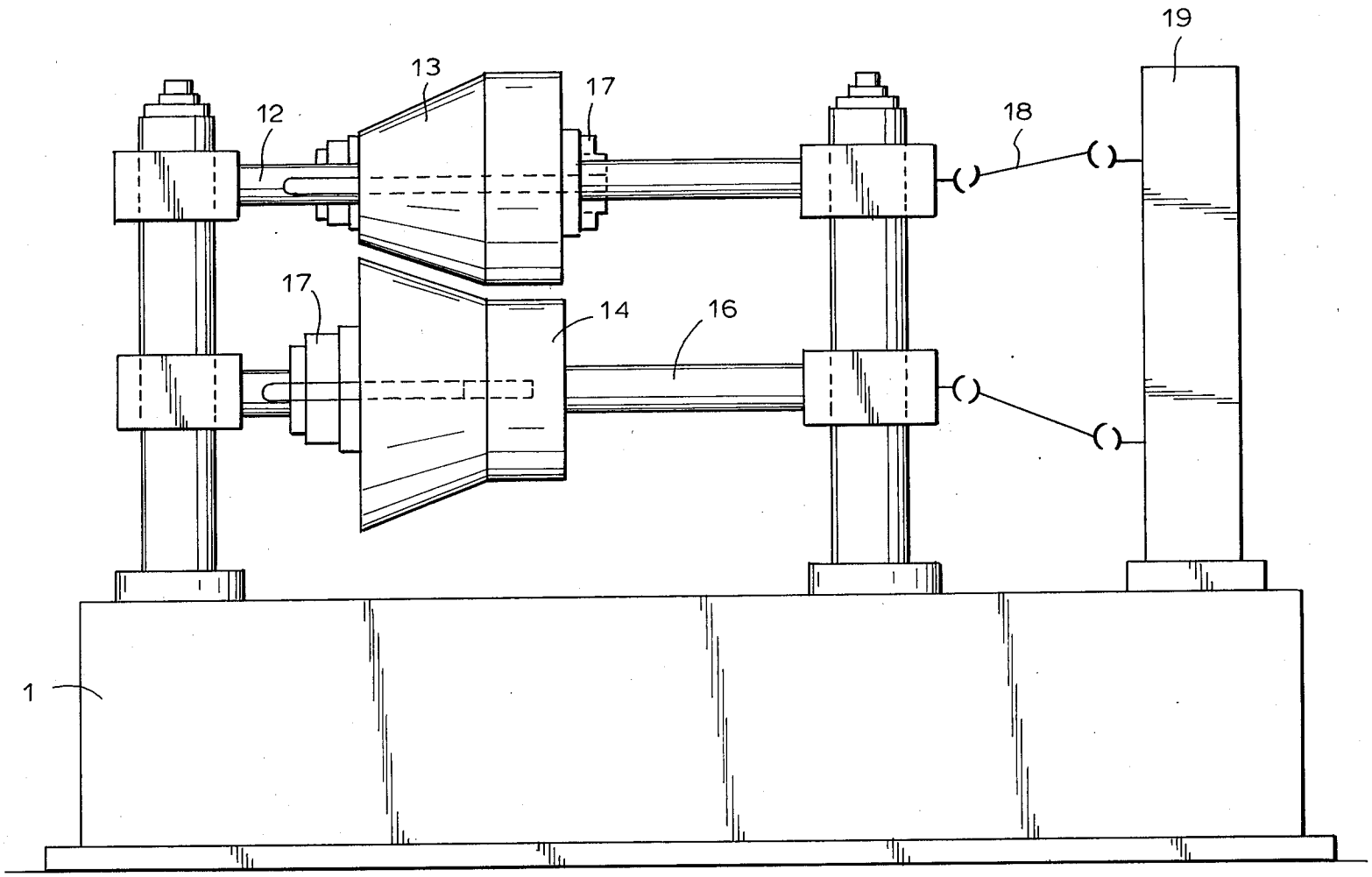
FIG. 2 shows a side view of a transition device in operation.

On the other side of the vertical bearers 7 are mounted with an optional shifting possibility in case of necessity, freely rotating cylindrical rollers 12, which copy by following the end fo the profile flange. The vertical bearers 7 are equipped with guides 20 along which the rotating cylindrical rollers 12 move freely. Over one of the module components 1 on the bearing framework, crosswise to the machine's axis is mounted a transition device (FIG. 2), which runs the work piece 11. The shape forming caliber of the transition device is composed of a top 13 and a bottom 14 shape forming block, which are mounted respectively on a top 15 and a bottom 16 horizontal rollers, with a possibility for axial shifting and fixing in operating position by means of fixing couplings 17. Couplings 17 can be any known fixing device between a roller and a cylindrical opening allowing movement along the roller when unfixed and preventing movement along the roller when fixed. At least one of the module components 1 is provided with a driving device 19 and connecting rollers 18.

The machine's operation runs as follows:

The initial work piece 11 for the desired type and profile dimension moves along the machine's axis through the separate transitions, pulled or pushed from the top 13 to the bottom 14 shape forming blocks. Depending on their mutual juxtaposition at the driven transition device position and on the consecutively changing juxtaposition of the freely rotating horizontal 8, cylindrical 9 and shape forming 10 rollers, the initial work piece 11 takes up the form of the desired profile.

The peripheral velocities of the rollers equal the progressive velocity of the initial work piece 11 without counting the sliding, only by friction through rolling.

In the cases of beams with different flange dimensions, the machine may be adjusted so that the freely moving cylindrical roller 12 shifts parallely to themselves along the horizontal bars 3, while the top 13 and the bottom 14 shape forming blocks are shifted axially along the respective top 15 and bottom 16 horizontal rollers.

The adjustment is finished by fixing the top 13 and the bottom 14 shape forming blocks, the bar blocks 5 and the freely rotating cylindrical roller 12 by means of the respective couplings 17.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. A roller machine for profile cold bending comprising a bearing framework with mounted supports;

said bearing framework comprising at least two module components, said supports being mounted at adjacent ends of said module components;

said machine having an axis;

a plurality of horizontal bars, said bars being connected between said supports and lying crosswise to the axis of the machine;

a plurality of end carriers, said end carriers being mounted on said horizontal bars;

a plurality of bar blocks, each of said bar blocks being supported by one of said end carriers, said bar blocks lying parallel to each other and parallel to the axis of the machine;

each of said bar blocks comprising a plurality lengthwise bars;

a plurality of vertical bearers, said vertical bearers being carried by said lengthwise bars;

each of said vertical bearers having two sides, one of said sides comprising a horizontal roller, a cylindrical roller, and a shape forming roller, secured at a fixed angle;

the other of said sides of each of said vertical bearers comprising guides and and axially movable free rotating cylindrical roller mounted on said guides;

an axially movable top shape forming block and an axially movable bottom shape forming block, said shape forming blocks being mounted on one of said module components and lying crosswise to said axis of said machine;

a top horizontal roller and a bottom horizontal roller, said top horizontal roller carrying said top shape forming block and said bottom horizontal roller carrying said bottom shape forming block; and top and bottom couplings for fixing in operating position said respective top and bottom shape forming blocks.

2. A roller machine for profile cold bending comprising a bearing framework with mounted supports;

a plurality of end carriers, said end carriers being mounted on said mounted supports;

said machine having a longitudinal axis;

a plurality of bar blocks, each of said bar blocks comprising a plurality of bars parallel to the longitudinal axis of the machine, and each bar block being supported by one of said end carriers;

a plurality of vertical bearers, said vertical bearers being carried by said bar blocks and said bar blocks being connected by said vertical bearers;

each of said vertical bearers comprising a horizontal roller, a cylindrical roller, and a shape forming roller, secured at a fixed angle and an axially movable free rotating cylindrical roller;

an axially movable top shape forming block and an axially movable bottom shape forming block, said shape forming blocks being mounted on said bearing framework and lying crosswise to said longitudinal axis of said machine.

3. A roller machine for profile cold bending, as claimed in claim 2, further comprising a top horizontal roller and a bottom horizontal roller, said top horizontal roller carrying said top shape forming block and said bottom horizontal roller carrying said bottom shape forming block; and top and bottom couplings for fixing in operating position said respective top and bottom shape forming blocks.

4. A roller machine for profile cold bending, as claimed in claim 2, further comprising said bearing framework comprising at least two module components, said supports being mounted at adjacent ends of said module components and said supports comprising a plurality of horizontal bars, said bars being connected pg,12 between said supports and lying crosswise to the longitudinal axis of the machine;

said end carriers being mounted on said horizontal bars;

each of said vertical bearers having two sides, one of said sides comprising said horizontal roller, said cylindrical roller, and said shape forming roller, secured at a fixed angle;

the other of said sides of each of said vertical bearers comprising guides and said axially movable free rotating cylindrical roller being mounted on said guides;

said shape forming blocks being mounted on one of said module components;

a top horizontal roller and a bottom horizontal roller, said top horizontal roller carrying said top shape forming block and said bottom horizontal roller carrying said bottom shape forming block; and top and bottom couplings for fixing in operating position said respective top and bottom shape forming blocks.

* * * * *